US007101136B1

(12) United States Patent
Ray et al.

(10) Patent No.: US 7,101,136 B1
(45) **Date of Patent: *Sep. 5, 2006**

(54) DRYWALL PANEL CARRIER

(76) Inventors: Charles T. Ray, 130 Lark La., Harvest, AL (US) 35749; David W. Peterson, 5024 Shaun Cir., Huntsville, AL (US) 35811

( * ) Notice: Subject to any disclaimer, the term of this patent is extended or adjusted under 35 U.S.C. 154(b) by 0 days.

This patent is subject to a terminal disclaimer.

(21) Appl. No.: 11/113,613

(22) Filed: Apr. 25, 2005

Related U.S. Application Data

(63) Continuation-in-part of application No. 09/842,584, filed on Apr. 25, 2001, now Pat. No. 6,511,275.

(51) Int. Cl.
*E04G 21/14* (2006.01)

(52) U.S. Cl. ..... 414/11; 414/10

(58) Field of Classification Search ..... 414/11
See application file for complete search history.

(56) References Cited

U.S. PATENT DOCUMENTS 2,815,132 A * 12/1957 Stone ..... 414/11
2,828,870 A * 4/1958 Corley ..... 414/11
3,157,386 A * 11/1964 Higgins ..... 254/4 C
3,305,219 A * 2/1967 Rhodes ..... 414/11
3,317,059 A * 5/1967 Higgins ..... 414/11
3,923,167 A * 12/1975 Blankenbeckler ..... 414/11
4,339,219 A * 7/1982 Lay ..... 414/11
5,584,635 A * 12/1996 Stapelmann ..... 414/11
5,762,348 A * 6/1998 Echternacht ..... 280/79.7
6,511,275 B1 * 1/2003 Ray ..... 414/11
2003/0190219 A1 * 10/2003 Young ..... 414/11

* cited by examiner

*Primary Examiner*—Dean J. Kramer
*Assistant Examiner*—Charles N. Greenhut
(74) *Attorney, Agent, or Firm*—Mark Clodfelter

(57) ABSTRACT

Apparatus for lifting and transporting drywall panels has a pair of panel-supporting legs of square tubing attachable to side rails of a lift platform. Each leg is connected to the rails by an upper bracket at the top of the leg and a lower bracket at a middle location. A panel-receiving U-shaped channel is located on the opposite side of the legs, away from the rails. The lower bracket has a standoff member projecting the bottom of the leg outward at an angle. A roller at the base of the channel provides low-friction rolling contact with an inserted panel, and a groove in this roller serves to guide the panel. Rollers at the tops of the legs and elsewhere are placed to keep panels from being damaged by contact with the legs.

15 Claims, 12 Drawing Sheets

DRYWALL PANEL CARRIER

CROSS REFERENCE TO RELATED APPLICATION

This application is a continuation-in part of application Ser. No. 09/842,584, filed Apr. 25, 2001, now U.S. Pat. No. 6,511,275, issued Jan. 28, 2003 and PCT application US2002/34527, filed Oct. 25, 2002.

FIELD OF THE INVENTION

This invention relates to handling of building panels at construction sites and more particularly to equipment for transporting and lifting of panels to an elevated position convenient for installers.

BACKGROUND OF THE INVENTION

Handling of building panels such as drywall or "Sheetrock" panels has presented difficulties, especially for large panels being installed in commercial buildings at heights above a first floor level. drywall panels for such applications may be as large as four feet by twelve feet and weigh one hundred pounds or more. It is readily apparent that any improvement in equipment and procedures for lifting such panels to a required elevated location would be welcomed by installers.

Use of scissors-type lift machines has become a common practice at commercial building sites. These devices have sets of paired extendable arms mounted on a wheeled and powered chassis and a work platform supported by the arms. For safety reasons the platforms have horizontal rails around their outer edges supported by upright posts. The rail structure generally includes an upper rail some three feet above the platform floor and a lower rail halfway between the floor and the upper rail. The rails generally take the form of square or round metal tubing. Lift platforms of this type may be eight feet by three feet or larger in size and provide space for two to three workmen. Such machines are exemplified by U.S. Pat. No. 6,158,550, issued Dec. 12, 2000 to Arnoldy, which patent is hereby expressly incorporated by reference.

Attempts have been made to use existing lift machines for lifting large panels along with the workmen to an elevated working level, with the panel being supported by measures such as placing the panel on edge on a workman's foot extending outside of the platform at each end. This approach is dangerous and difficult to maintain for the period of time required to move the machine from a stack of panels to a desired final location. Other approaches such as placing the panel on top of the platform rail are not effective for large panels owing to a lack of space, and may result in damaging the panel when it comes into contact with metal surfaces or corners.

Desirable features for a panel-supporting device include a bottom channel adapted to allow a panel to be slid on edge into transporting position under conditions avoiding exposure of the panel to scraping or tearing, a means to restrain the panel from sliding out during transport and a means to facilitate movement of the panel when lifted by workmen off the device and into position for installation.

SUMMARY OF THE INVENTION

The present invention is directed to apparatus for lifting and transporting panels of material such as drywall to a desired location at a construction site. The apparatus comprises a pair of panel-receiving legs attachable to side rails of a lift platform, with the legs when attached extending generally in a vertical direction. Square metal tubing is a suitable material for making the legs.

Each of the legs has a top. bottom and midpoint along its length, an inside surface facing the platform when installed and an outside surface facing the opposite direction. Means are provided for removably connecting the tops of the legs to the upper rail and midpoints to the lower rail of a lift platform. Clamps connected to the rails and having opposing jaws engaging the rails or u-shaped brackets secured by pins may be used.

The legs each have a panel-receiving channel at the bottom of the leg and on the outside thereof, with a low-friction contact member at the base of the channel to obtain enhanced rolling or sliding movement of the panels. The contact member may comprise a material such as a plastic having a slick, low-friction surface or a roller. A preferred structure is to use a spool-shaped roller having lips on its ends, defining a groove between the lips of sufficient width to receive the thickness of the panel and guide it along, preventing the panel edge from coming in contact with metal components of the leg. This protects the panel edge area from being scratched or damaged.

Low friction contact surfaces may also be provided at various other locations so as to keep the panels from being slid over surfaces which would present higher friction. This feature maybe implemented in the form of rollers placed to guide panel faces as well as edges from coming into contact with other structural components of the legs.

An additional roller may be provided at the top of the leg mounted on an axis parallel to the platform rail. This roller is placed to keep the panel from coming into contact with other structure of the top of the leg when the panel is lifted up for movement to a position required for installation. In addition this roller serves as a pivot point around which the panel is manipulated and guided by the workmen.

To provide for easier handling of panels and to keep them from tipping outward at the top while being moved the bottoms of the legs may be positioned outward from the platform floor while the tops are held close to the top rail, causing the panel to be tilted slightly inward at the top. This result may be obtained by mounting the lower clamp on a standoff member of a suitable length whereby the leg is projected outward at the bottom. Inclining the leg at an angle of ten to fifteen degrees is preferred.

Variations in distance between upper and lower rails of different platform lifts may be accommodated by mounting the lower clamp on a sleeve which fits over the leg and is free to move upward and downward within limits.

Another feature of the invention is to provide an adaptation for use in lifting narrower panels having a width such as two to three feet. The panel-receiving structure may be mounted with bolts and wing nuts at the bottom end of the leg or at an alternative location upward from the bottom. The upper location enables the upper edge of narrower panels to reach the level of the upper roller when placed in position to be lifted.

The invention also may include a braking mechanism for the rollers at the base of the channels of the legs in order to prevent unintended rolling or sliding when the platform stops or starts. This may be provided in the form of pins insertable in openings in the rollers or a friction brake.

Apparatus embodying the invention provides important advantages, particularly in the ease and convenience of moving large and heavy panels to a position which is optimum for further movement a final location for installation. Safety and productivity are thereby enhanced, and damage to panels is reduced.

It is accordingly an object of this invention to provide a panel-carrying attachment for lift platforms.

Another object is to provide a panel-carrying attachment having low friction, load-bearing surfaces enabling ease of handling panels.

Yet another object is to provide a panel-carrying attachment which includes means for protecting panels from being damaged.

Other objects and advantages of the invention will be apparent from the following detailed description and the appended claims.

DESCRIPTION OF THE PREFERRED EMBODIMENT

Figures 1, 4:
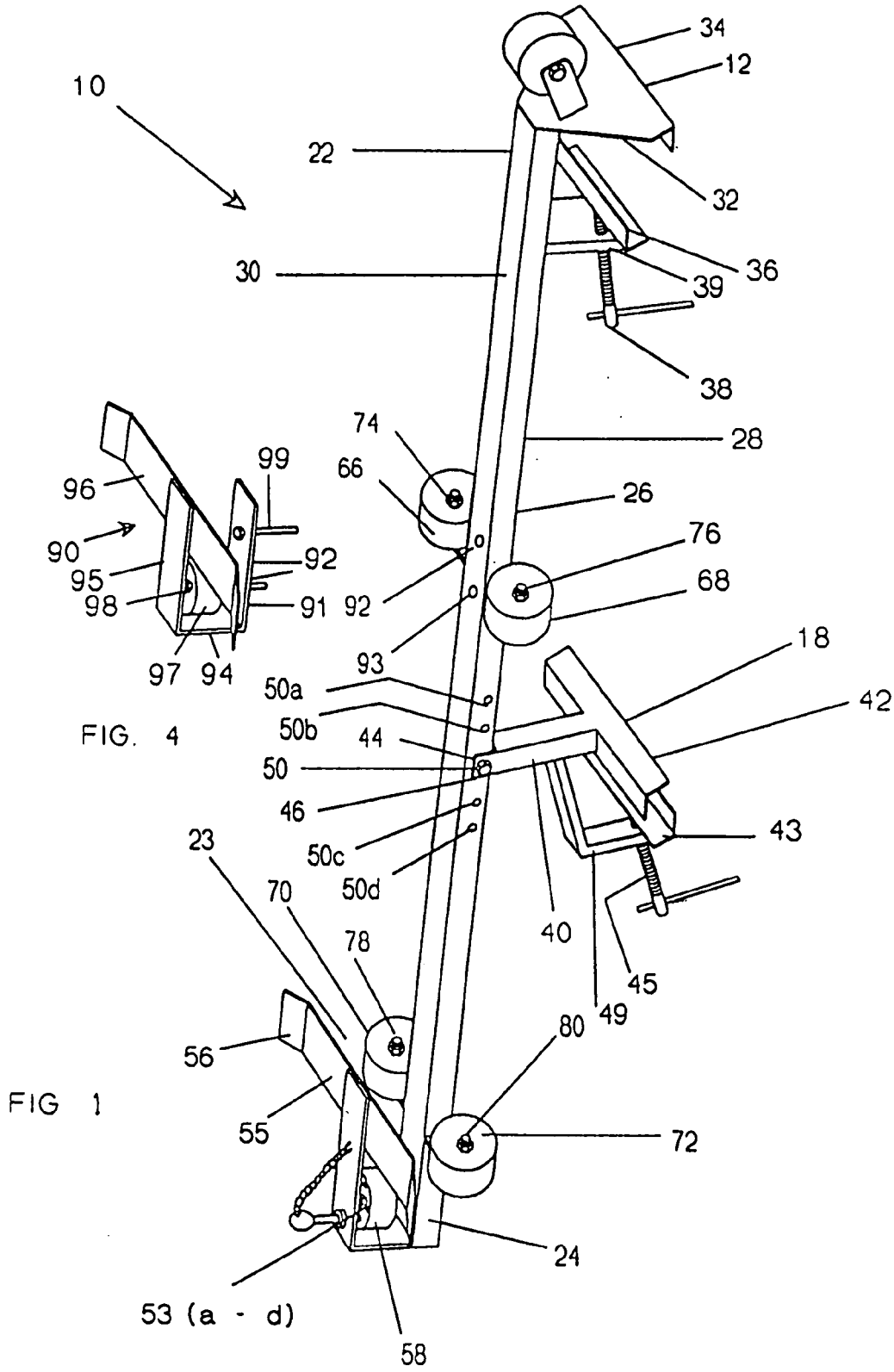
FIG. 1 is a perspective view of a panel-supporting leg embodying the invention.
FIG. 4 is a perspective view of a panel-receiving assembly removably attachable for use with narrow panels.

Referring to FIG. 1 of the drawings there is shown a panel-supporting leg 10 which is a component of a panel-lifting and carrying apparatus embodying the invention. Two such legs are required at spaced-apart locations along the length of a lift platform for effective support of panels. Each of the legs has a pair of clamps located on the inside of the leg, upper clamp 12 attachable to an upper horizontal rail 14 of a lift platform 16 and a lower clamp 18 attachable to a lower rail 20 of the platform.

Leg 10 preferably takes the form of a straight piece of square metal tube which may have a width of one inch and a length of three feet. The leg has a top end 22, a bottom end 24 and a middle area 26 between the ends. Flat side 28 of the leg is positioned on the inside of the tube facing the rail and opposing flat side 30 faces outward away from the rail.

Upper jaw clamp 12 is rigidly connected to plate 32, which in turn is joined to top end 22 of the leg and which extends inward to flat side 28 of the leg. Upper jaw 34 of this clamp comprises a segment of L-shaped angle iron adapted to fit over the inside upper corner of rail 14. Lower jaw 36 of this clamp has a similar structure to the upper jaw and is supported by adjustable screw 38 mounted on stud 39 connected to the leg.

Lower clamp 18 is also located on the inside of the leg and is arranged to come into clamping contact with lower rail 20. Clamp 18 has an upper jaw 42 and lower jaw 43 supported by an adjustable screw 45 mounted on support arm 49 which is connected to standoff arm 40. This clamp in the embodiment shown is connected to the leg at a middle portion 26, and may be varied to compensate for differences in rail placement on different platforms, as is described below. A standoff arm 40, disposed between upper jaw 42 of clamp 18 and attachment bracket 44 causes the bottom end of the leg to be projected outward away from the platform at a selected acute angle such as 10 to 15 degrees from vertical. This extent of slanting enables easier grasping and handling of the panel, particularly when the panel is removed by being lifted in a direction backward over the workmen's heads. Capability for movement of clamp 18 over a narrow range is provided by pivotally mounting of bracket 44 around pin 46 through hole 50. A series of vertically spaced apart alternate holes 50*a* to 50*d* are provided to allow for mounting at varying heights.

Figure 2:
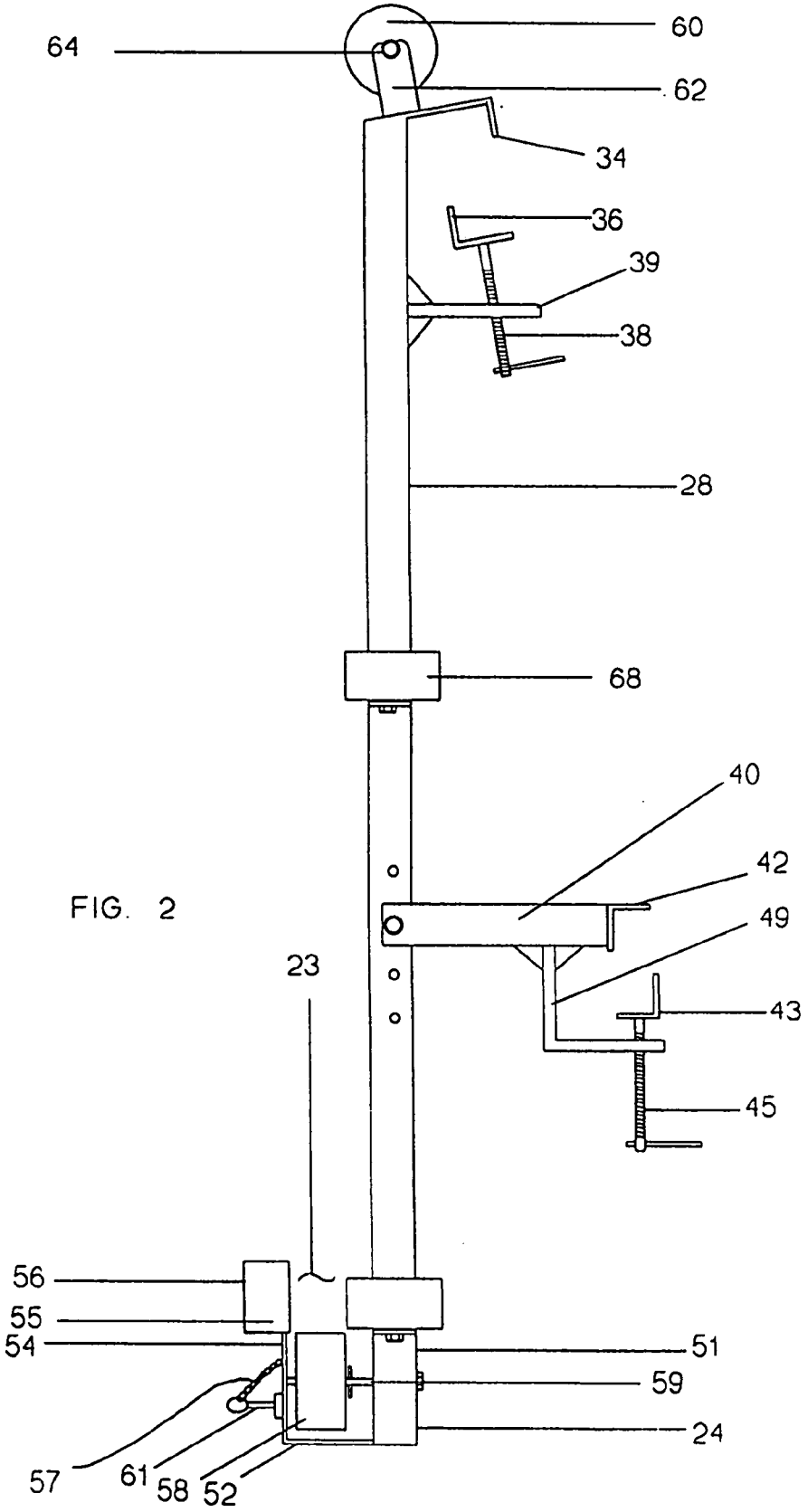
FIG. 2 is an elevational view thereof taken from a side.

A panel-receiving channel 23 (FIG. 2) is provided at the bottom end 24 of the leg and adjacent to outside flat side 30. The channel may be formed by an end portion 51 of the leg, a horizontally extending bottom plate 52 and a short vertically extending plate member 54, which may be a bent over extension of plate 52. A horizontally extending guide 55 in the form of a plate attached to vertical plate 54 and having end portions 56 bent outward is provided to restrain panels from moving laterally out of position. A roller 58 is mounted on axle 59 extending from leg portion 51 to vertical plate 54, providing an axis of rotation perpendicular to the leg. The weight of the panel being carried rests fully on the load-bearing roller 508 so that a very low extent of friction is encountered when the panel is slid into position.

Figure 3:
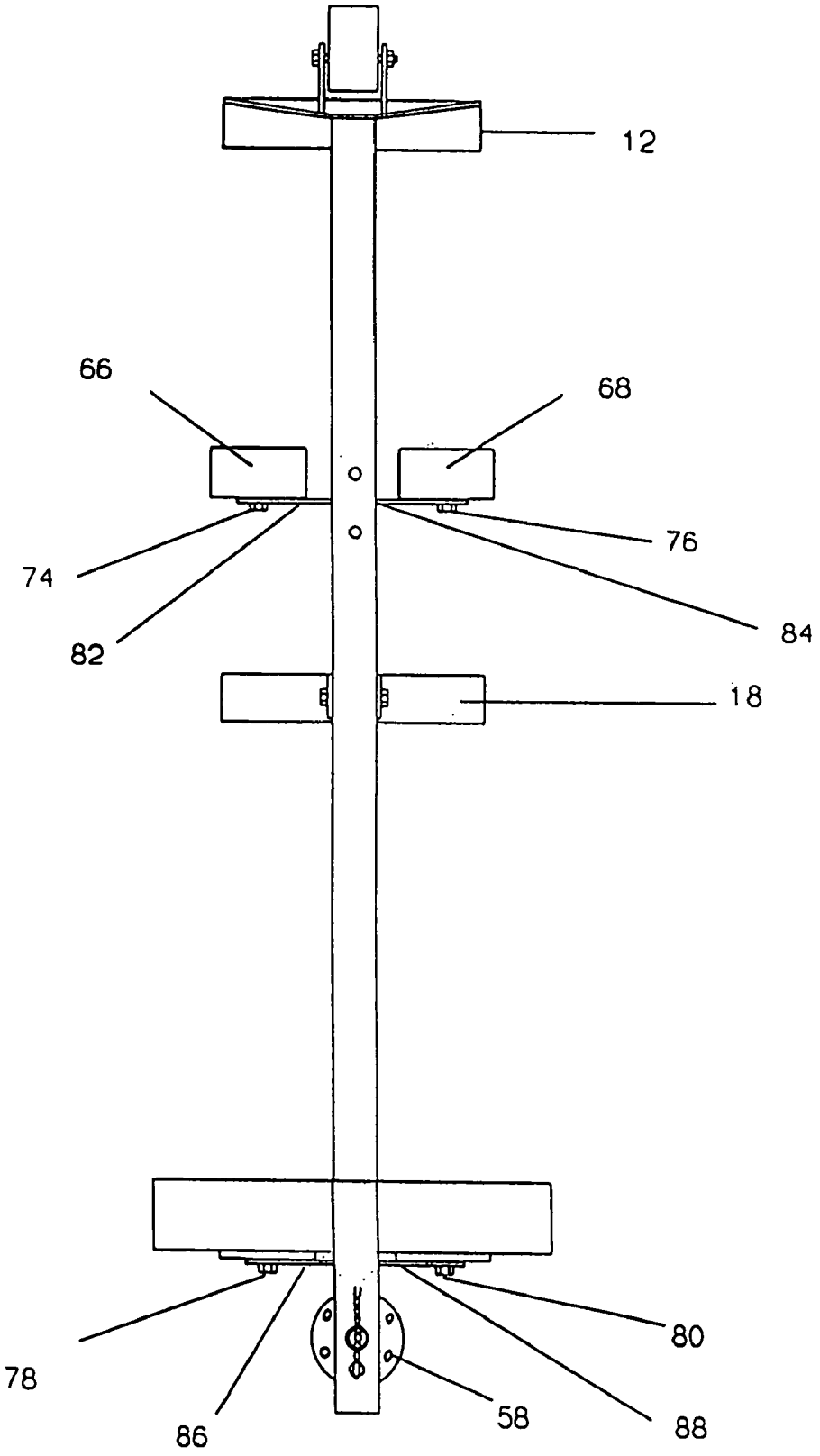
FIG. 3 is an elevational view taken from outside the leg when installed.

In addition to roller 58 located at the base of the channel other rollers may be provided at the top end of the leg and at side positions to facilitate handling of the panels and to restrain panels from coming into contact with other structural elements. Roller 60 is placed at the top end 22 of the leg, mounted on U-shaped bracket 62 on axle 64 which is generally perpendicular to the leg. This roller facilitates removal of the panel when being raised upward for unloading. Placement of the roller with its circumference slightly outside of side 30 of the leg keeps the panel from coming into contact with the leg. Sets of rollers 66, 68 and 70, 72 are provided on opposing sides of the middle 26 and bottom 24 of the leg, respectively. These rollers are mounted on axles 74, 76 and 78, 80 parallel to the leg and supported by plates 82, 84 and 86, 88 (FIG. 3) perpendicular to the leg. Placement of these rollers with their circumference spaced outside of the level of leg avoids contact of the panels with the legs and facilitates movement of panels into and out of position.

It is noted that only one of the rollers of sets 66, 68 and 70, 72 would be required in operation, that one being the roller which first comes into contact with a panel being loaded, that is the roller on the side facing the panel in the direction from which the panel is moving. Placement of the rollers on both sides is preferred, however, to enable any leg to receive panels from both directions.

Ball-bearing rollers with wheels made of heavy plastic such as are used in roller skates may be used, with suitable dimensions being a diameter of two inches and a width of one and one-fourths inches.

FIG. 1 shows a safety feature in the form of a roller-locking mechanism incorporated in apparatus of this invention. To permit panels from sliding off of the channels in which they are supported, particularly when the lift platform is being moved after loading, a locking pin 61 may be inserted into a hole 53*a*–53*d* in the bottom roller 58, the pin also passing through a hole in plate 54. To avoid loss of pin 61 it may be secured to the plate by means such as a chain 57.

FIG. 4 shows an embodiment wherein a channel assembly 90 is provided for removable attachment to leg 10 at an intermediate position adjacent to rollers 66, 68. The assembly is formed into a U-shaped bracket 91, including a vertical segment 89 attachable to leg 10 at holes 92,93, a base segment 94 and an outer vertical segment 95 connected to guide 96 at the upper end thereof. Roller 97 mounted on axle 98 is positioned in the same manner as for roller 58. Connection of the assembly to leg 10 is enabled by bolt 99, which extends through hole 92. Axle 98 which supports the roller may also extend slightly into hole 93. This removable assembly could also be used at the bottom of the leg by making slight modifications to the leg. This assembly provides for convenient handling of narrow panels having a width such as two feet, which might otherwise come into direct contact with surfaces of the legs.

In order to prevent overloading of the panel lifting apparatus, as might occur if too many heavy panels were placed on the legs at one time, the width of panel-receiving channels 23 is preferably limited to a distance between rollers 70, 72 and guides 55 of about one to one and one-half inch. This would allow room for only one panel, with enough slack provided to enable free movement. Also, after one panel is loaded on the supporting legs, it would be difficult to load a second one because rotation of the rollers when the second panel is being slid into position would cause the first panel to be moved outward.

In operation of the apparatus of this invention for installing wall panels, it is preferred to bring the lift platform, when loaded, into a position such that the legs and supported panel are located on a side rail away from the wall. This allows the opposite side of the platform to be brought closer to the wall and minimizes the distance over which the installers would need to reach. Removal of the panel from the legs and into position on the wall also proceeds more smoothly then if the legs were on a side adjacent the wall.

Although the invention is described with reference to drywall panels, it is to be understood that the panels may be comprised of other materials such as plywood and other wood-based compositions as well as polymeric materials such as poly-carbonates and glass.

The posts used for panel-supporting legs preferably may be metal tubes having a rectangular or square cross-section but the invention includes posts in the form of shapes such as angle iron, beams, or the like.

Figure 5:
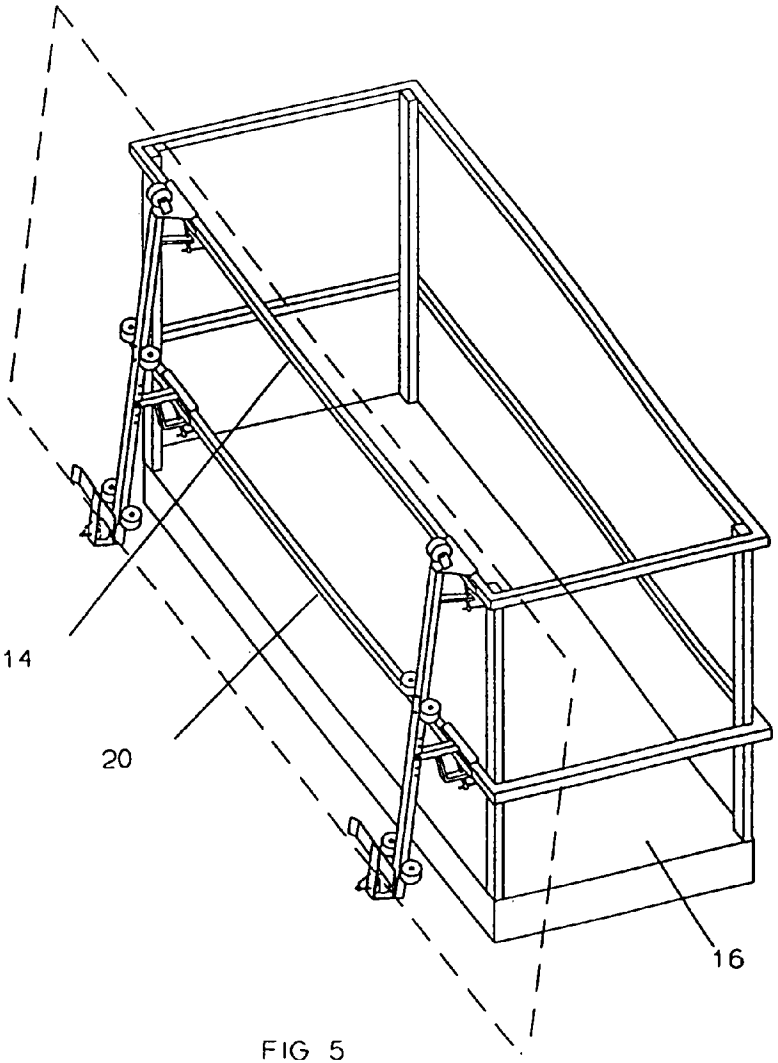
FIG. 5 is a perspective view showing a pair of legs installed on rails of a lift platform, with a drywall panel shown in dashed lines.
Figure 6:
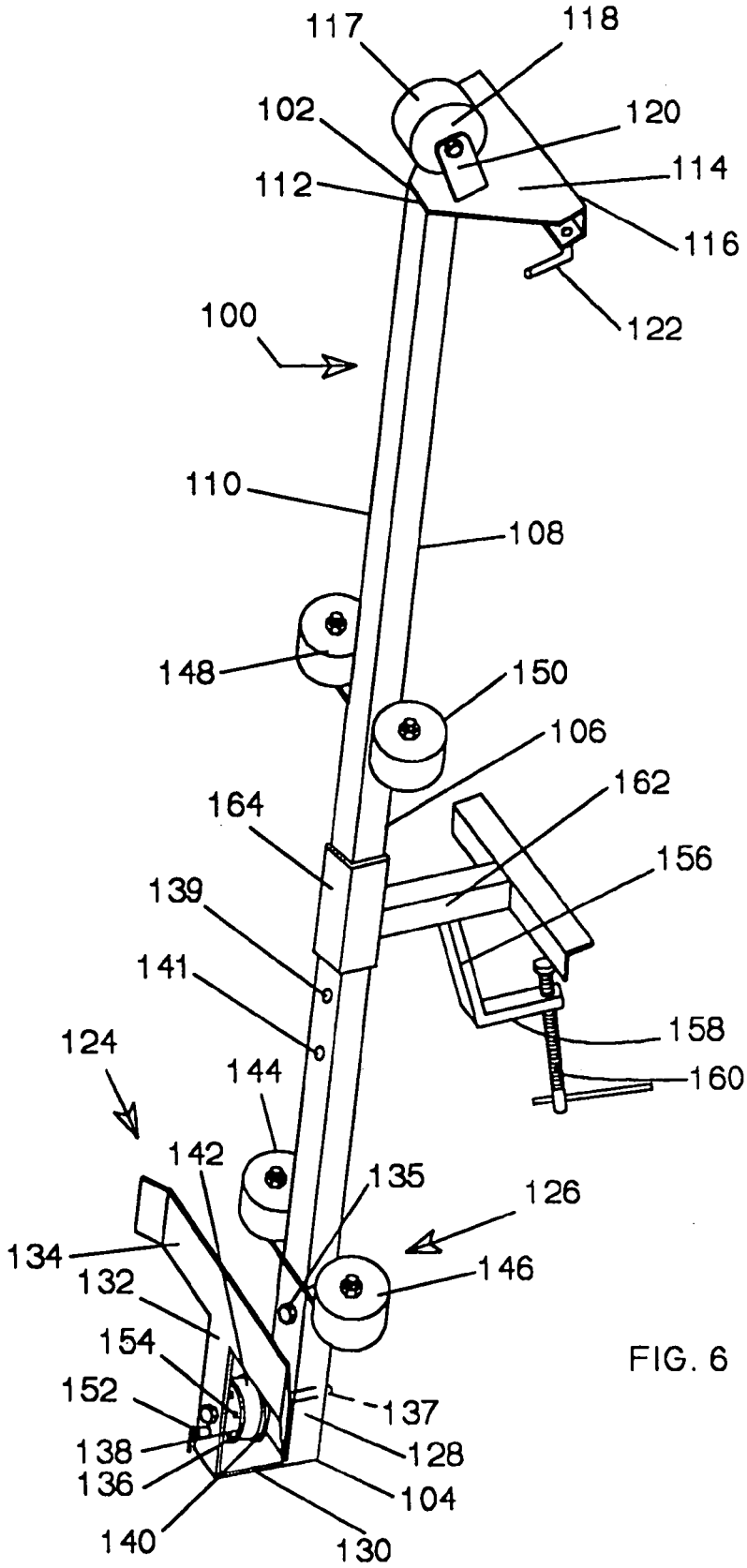
FIG. 6 is a perspective view of an embodiment of the invention using a grooved roller at the base of the panel-receiving channel.

Referring to FIG. 6 of the drawings there is shown a panel-supporting leg 100 which is a component of a panel-lifting and carrying apparatus embodying the invention. Two such legs are required at spaced-apart locations along the length of a lift platform for effective support of panels. Leg 100 preferably takes the form of a square metal tube which may have a width of one inch and a length of three feet. The leg has a top end 102, a bottom end 104 and a middle area 106 between the ends. Flat side 108 of the leg is positioned on the inside of the tube when connected to upper horizontal rail 14 and lower rail 20 of the lift platform (FIG. 5), and flat side 110 is positioned away from the rails.

An upper plate 114 is connected across top end 102 of the leg, providing support for a U-shaped bracket 116 defined in the inner end of the plate and for a roller 118 mounted on tabs 120 connected to the plate. Bracket 116 is adapted to be hooked over the upper rail and secured by a set screw or bolt 122. Roller 118 is placed so that its outer circumference 117 extends past edge 112 of plate 114 at its juncture with top end 102 at flat side 110, thus keeping the carried panel spaced outward from metal components at the top of the leg. Rollers 118 also provide convenient pivot points guiding movement of the panel during an initial step of unloading at an installation site.

A panel-receiving channel 124 is provided adjacent the lower end of the leg or at an alternate higher location when adjustment is made for narrower panels. Components which form the channel in combination with the leg may be provided in the form of an assembly 126 adapted to be bolted on at the selected location. In the embodiment shown in FIG. 6 a vertically slidable assembly 126 includes a U-shaped bracket 128 conforming to the shape of the leg, a base plate 130, a vertical side plate 132 and a horizontal guide plate 134 parallel to the bracket base.

A roller 136 is mounted above base plate 130 on an axis perpendicular flat side 110 of the leg. The roller has lips 138,140 at each end, defining a groove 142 in which edge portions of panels pay be placed, These rollers support the weight of the panel as it is being slid into position and result in less effort being required for loading. The grooves serve to keep edges of the panel bearing down on the rollers from sliding over and coming into contact with metal framework owing to tilting of the panels, which is carried out in order to obtain an optimum orientation for unloading.

The assembly 126 may also include a pair of rollers 144, 146 mounted on bracket 128 on axes parallel to the leg and having their circumferences spaced into the channel so as to keep faces of the panel from coming into contact with the leg. A similar pair of rollers 148,150 may be mounted on the leg at a middle point of the leg, these rollers serving the same purpose as rollers 144, 146 and being oriented in the same direction.

Assembly 126 also includes a braking mechanism for locking roller 136 in place once a panel is loaded so as to prevent panels from sliding off when movement of the lift platform is started or stopped. A locking pin 152 carried in plate 132 may be inserted in a selected aperture 154 in roller 136 to restrain the roller from rotating.

Assembly 126 may be secured in place at the bottom of the leg by bolts or pins 135, 137 extending through apertures in the bracket and the leg (not shown). Alternate apertures 139 and 141 are provided at a location one foot higher on the leg, Additional apertures at other locations may also be used.

A bracket 156 is provided at a middle location on the leg for connecting it to the lower rail of the lift platform. This bracket has a U-shaped structure with an opening on a side away from the leg, the bottom plate 158 of the bracket carrying a screw 160 which may be used to close the opening when the bracket is in place over the rail. The bracket is carried on a standoff arm 162 which in turn is connected to a sleeve 164. The sleeve fits loosely over the leg so as to allow the bracket to be moved to different levels for use on lift platforms having this rail located at varying levels.

Standoff arm 162 is used to impart a slight tilt to the leg, resulting in the panel being inclined outward at the bottom. This stabilizes the panel during movement of the lift platform and facilitates performance of an initial step wherein workmen unloading the panel are required to lift the panel over their heads. The standoff arm may preferably have a length sufficient to incline the leg at an angle of ten to fifteen degrees away from vertical.

Figure 7:
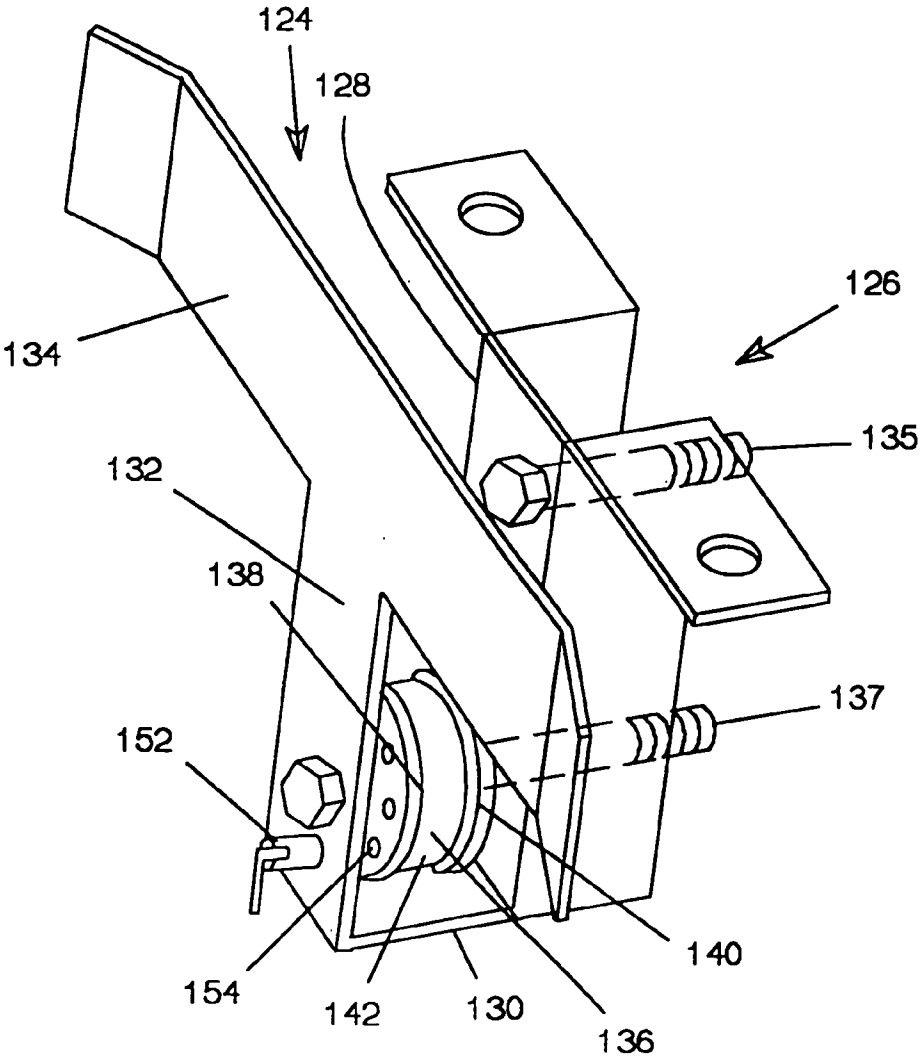
FIG. 7 is an enlarged view of a panel-receiving assembly of FIG. 6.
Figure 8:
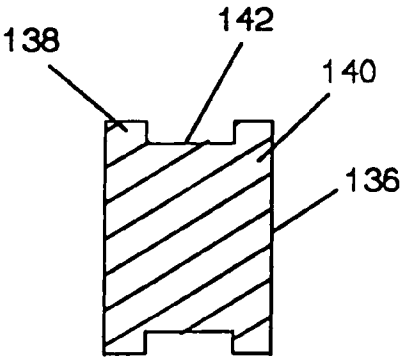
FIG. 8 is a sectional view of the bottom roller of FIG. 6.
Figure 9:
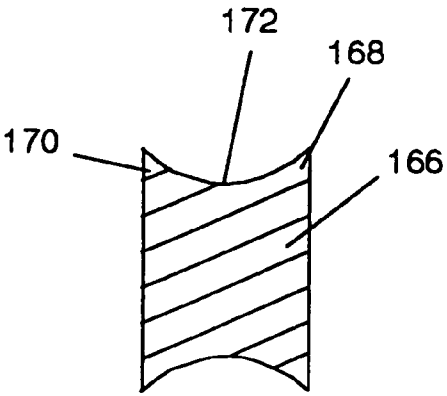
FIG. 9 is a sectional view of an alternate roller.

FIG. 8 shows details of roller 136, which is located at the base of assembly 126 in FIG. 7. The roller has lips 138 and 140 at opposite sides, defining a groove 142 with a flat bottom between the lips. Groove 142 has a width sufficient to receive an edge portion of a panel and guide it along as the panel is moved into position. This measure serves to prevent damage to bottom edges of panels, which might otherwise occur due to a tendency of a tilted panel to slide over and come into contact with metal components of the assembly. FIG. 9 shows another embodiment alternative to the roller shown in FIG. 8. In this embodiment roller 166 has a concave arcuate groove at its center disposed between side end portions 168 and 170.

Figure 10:
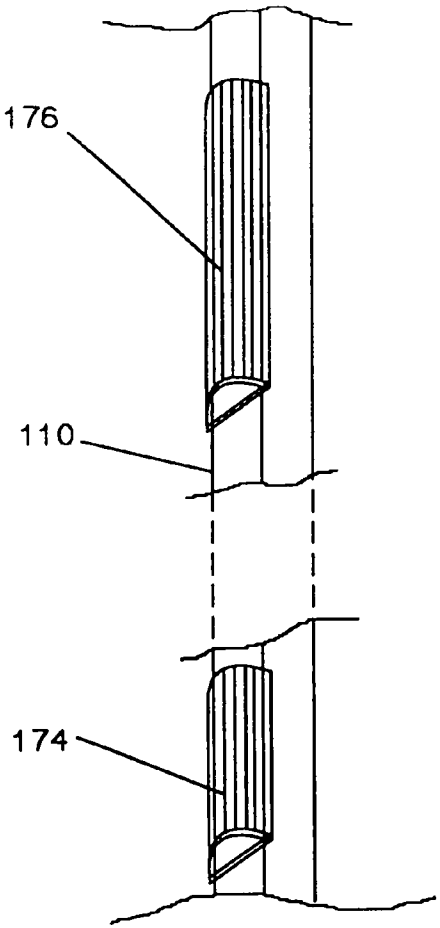
FIG. 10 is a fragmentary view showing use of a plastic bumper to protect panels from damage.

FIG. 10 shows an embodiment where bumpers 174 and 176 are applied to outside surface 110 of the leg at positions where the panel might come into contact with metal surfaces or corners of the leg. The bumpers are preferably semicircular in shape and may be made of high molecular weight plastic, which is a commercially available product characterized by having a low-friction surface. This measure may be used as an alternative to providing rollers at all locations except at the base of the panel-receiving channel and at the top of the leg.

In order to prevent overloading of the panel lifting apparatus, as might occur if too many heavy panels were placed on the legs at one time, the width of panel-receiving channel 124 is preferably limited to a distance between rollers 144 and 146 and guides 134 of about one to one and one-half inch. This would allow room for only panel, with enough slack provided to enable free movement. Also, after one panel is loaded on the supporting legs, it would be difficult to load a second one because rotation of the rollers when the second panel is being slid into position would cause the first panel to be moved outward. The width of groove 142 in roller 136 further limits loading to a single panel of drywall material.

In operation of of the apparatus of this invention for installing wall panels, it is preferred to bring the lift platform, when loaded, into a position such that the legs and supported panels are located on a side rail away from the wall on the panels are being installed. This allows the opposite side of the platform to be brought closer to the wall and minimizes the distance over which the installers would need to reach. Removal of the panel from the legs and into position on the wall also proceeds more smoothly than if the legs were on a side adjacent to the wall.

By reducing the amount of manual physical effort required on the part of workmen in lifting and transporting drywall panels, use of the invention may allow a reduction in the number of workmen needed for a crew performing this work. Under typical conditions, only two men would be needed instead of three as previously required for operation of a lift platform in installing large drywall panels.

FIGS. 1 to 5 are directed to embodiments of the invention wherein certain features of the embodiments of FIGS. 6 to 10 are lacking, in particular use of a grooved roller at the base of the panel-receiving assembly.

Figure 11:
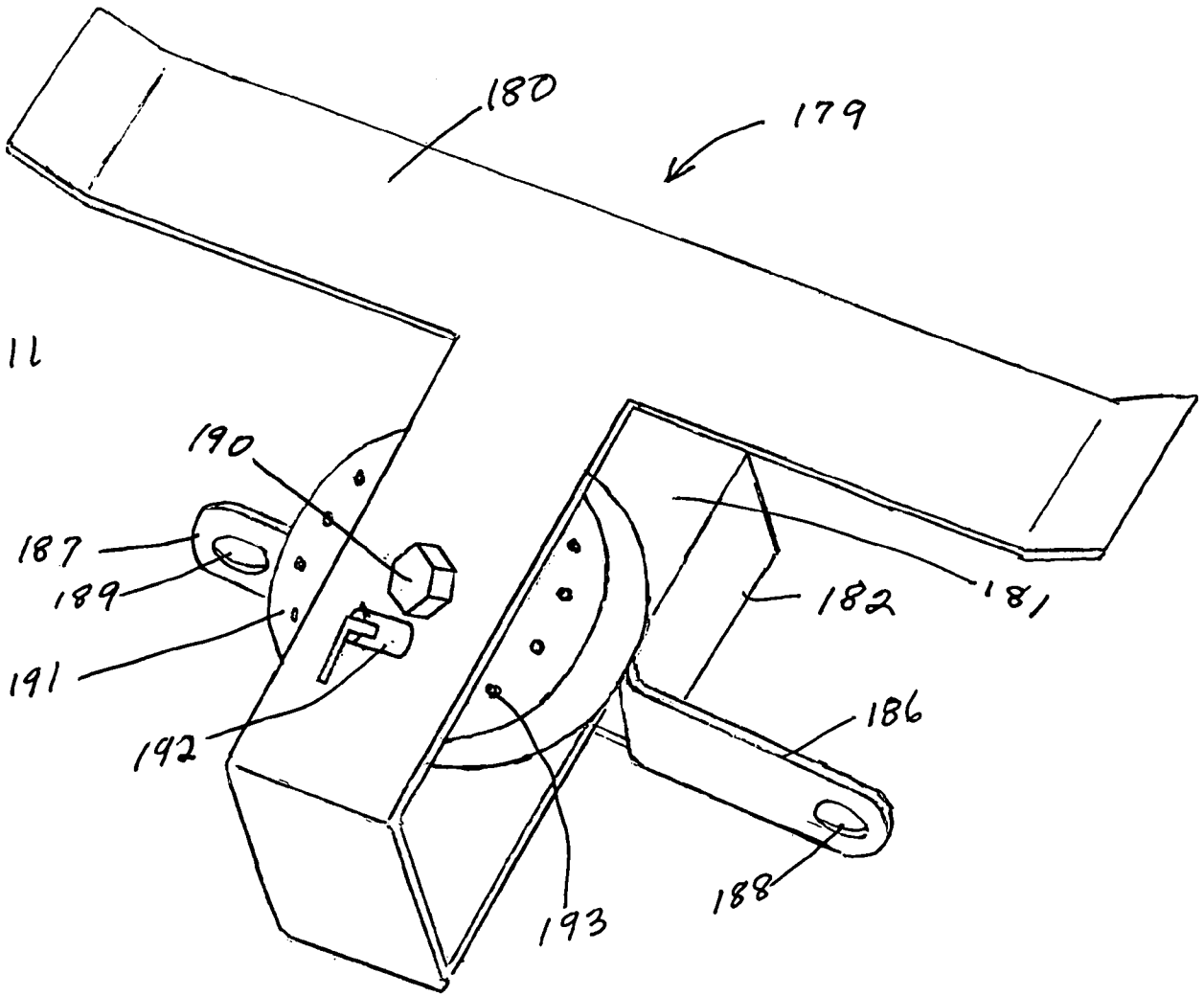
FIG. 11 is a front view of an alternate embodiment of a panel-receiving assembly, also known as a carrier.
Figure 12:
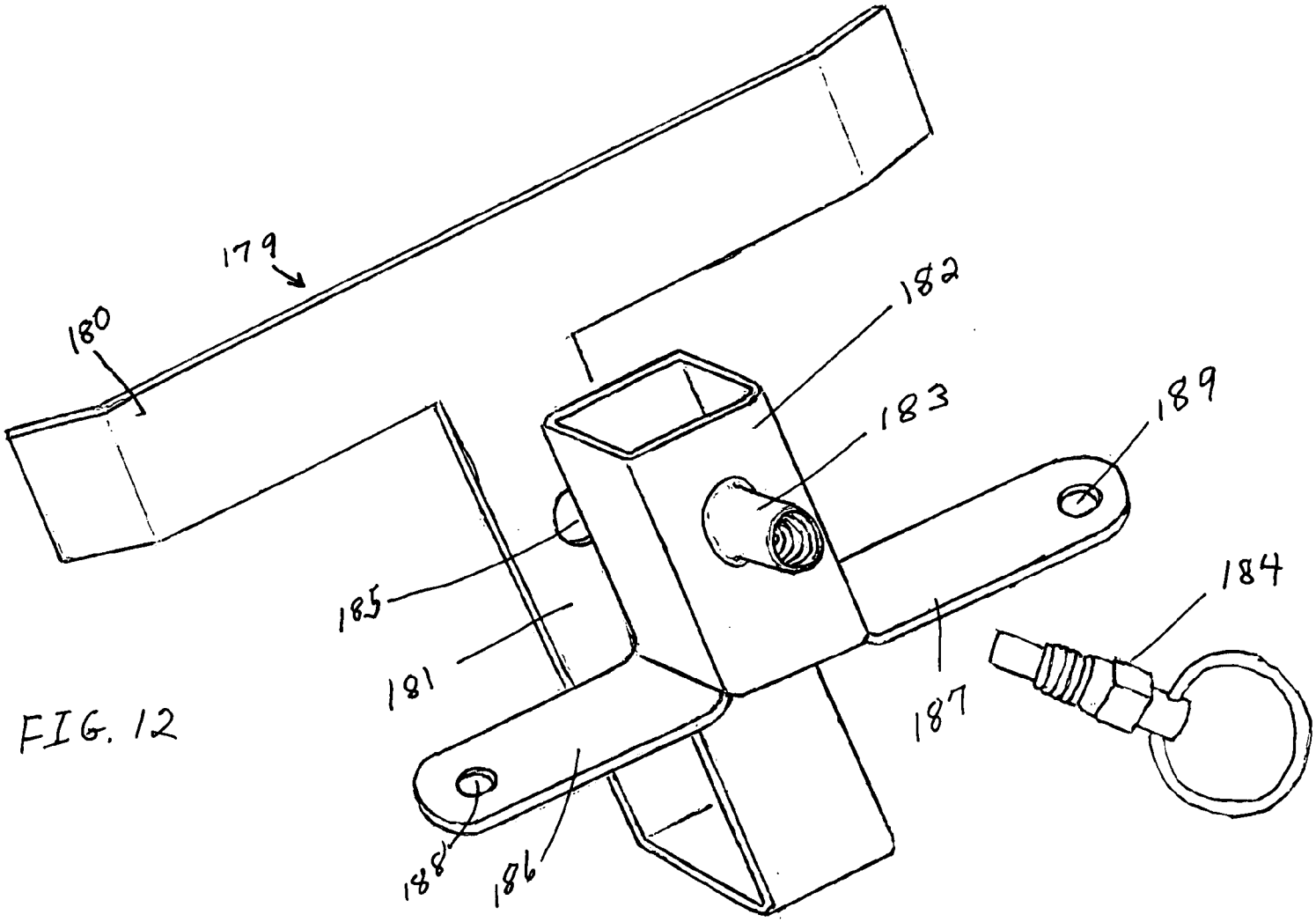
FIG. 12 is a back view of the assembly of FIG. 11.

FIGS. 11 and 12 show an alternate embodiment wherein the panel-receiving carrier assembly as depicted in FIG. 6 is modified to provide for mounting the rollers 144 and 146 on the carrier assembly 179, rather than having them bolted to the leg. The carrier assembly has a guide plate 180 integral with plate portions forming a U-shaped channel 181. A sleeve 182 is configured to slide up and down the lower part of the leg so as to be positioned at a selected height. The sleeve has a tubular stub 183 for receiving a spring-driven pin 184 which extends into an aperture in the leg and is much quicker to engage than previously used bolts. Channel plate 181 has an aperture 185 for receiving a bolt 190, which supports roller 191. A spring-driven pin device 192 is provided for locking the roller by engaging a side aperture 193. The sleeve also has a pair of apertured plates 186, 187 extending outward at the bottom thereof at a right angle for use in supporting rollers mounted at the apertures 188, 189.

Figure 13A:
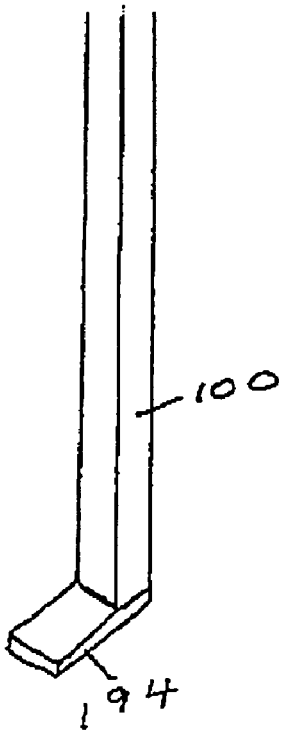
FIGS. 13*a* and 13*b* is a view of showing a welded stop at the base of a leg.
Figure 13B:
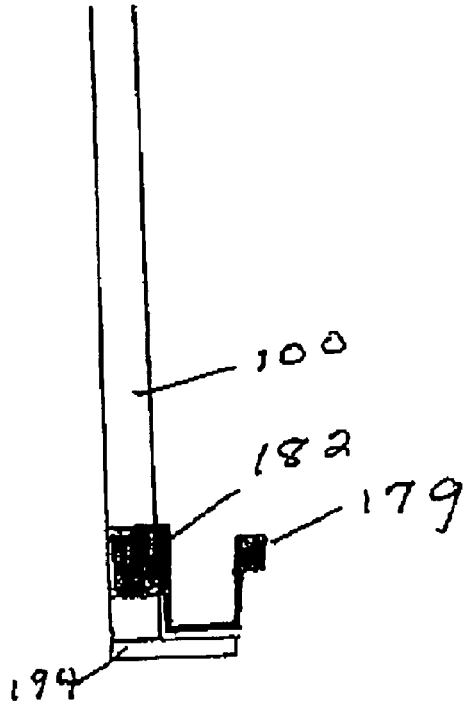

FIGS. 13*a* and 13*b* show a safety feature provided at the base of leg 100, in the form of a bottom stop 194 welded to the base. This prevents sleeve 182, which is connected to carrier assembly 179, from sliding off the leg.

Figure 14:
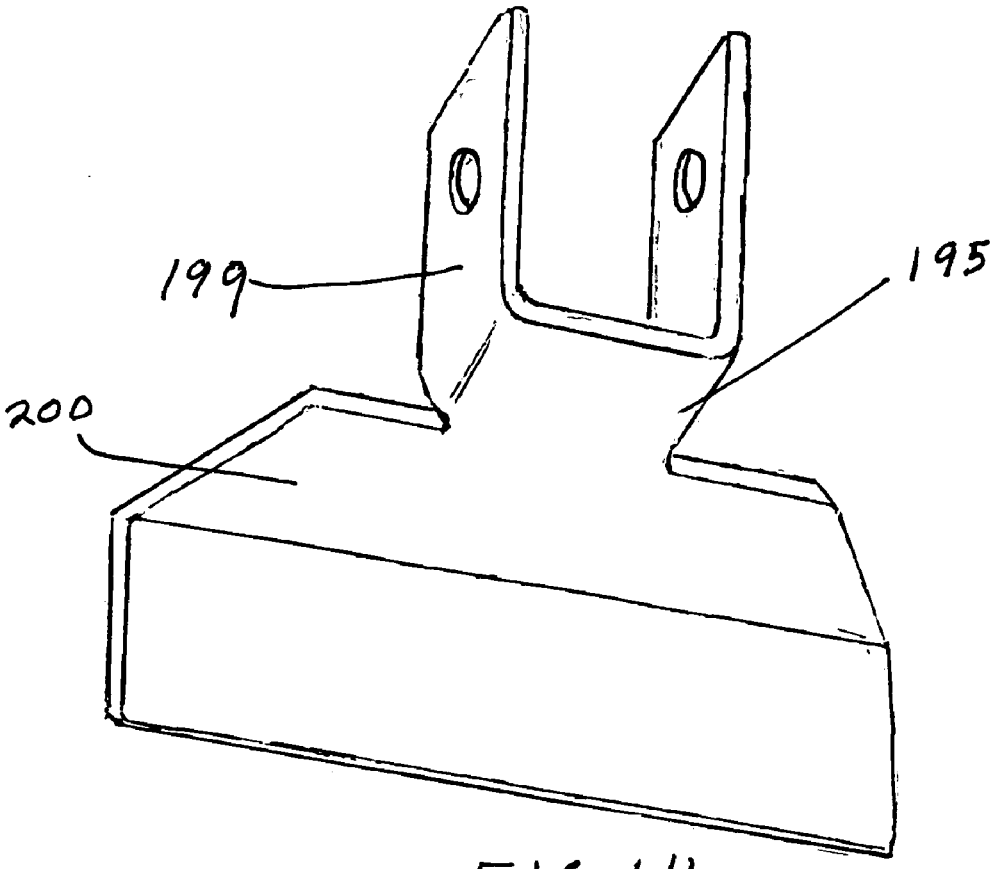
FIG. 14 is a top view of a modified top wheel support.

FIG. 14 is directed to an improved mounting device 195 formed by use of flat-pattern techniques. The device includes a roller mount 199 integral with bracket 200 configured to hook over a rail to which it is attached.

Figure 15:
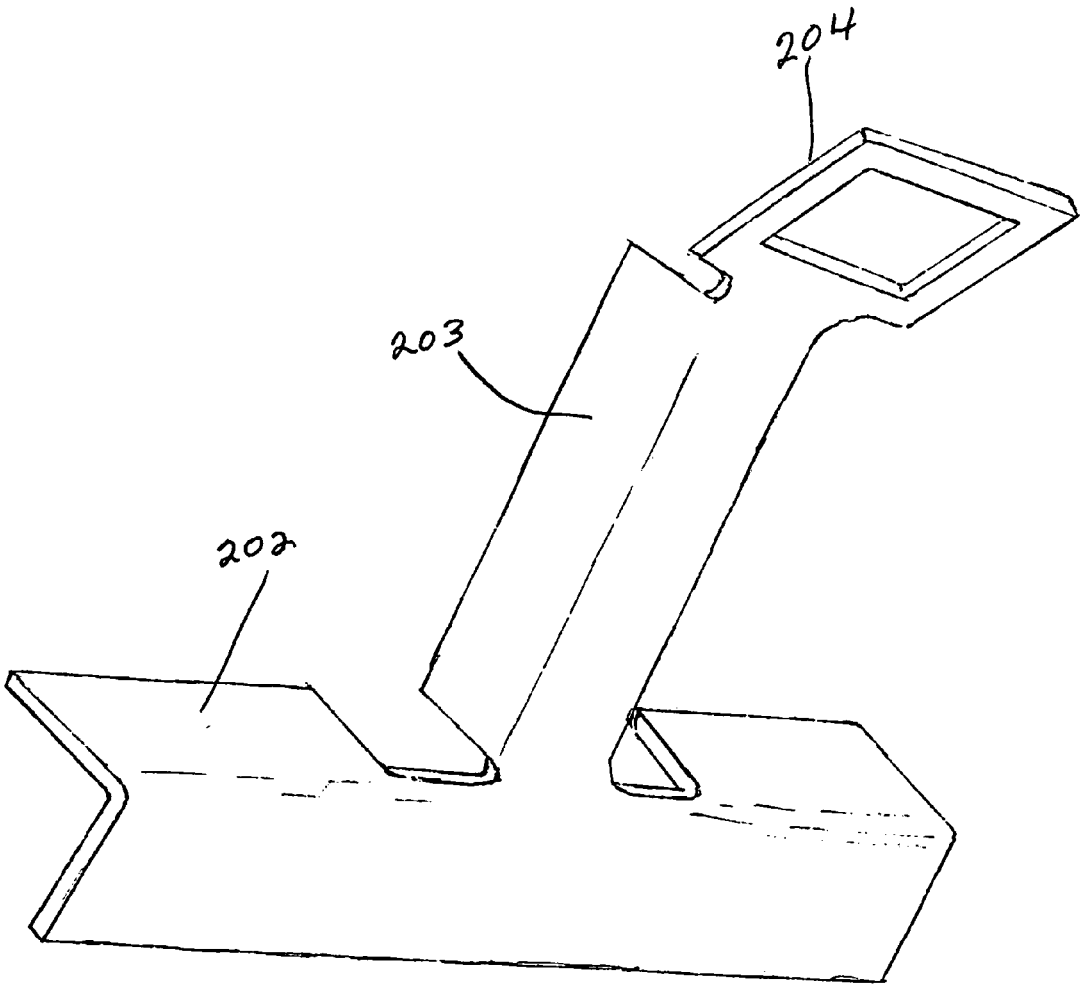
FIG. 15 is a front view of an alternate embodiment of a flat-pattern standoff device.

FIG. 15 shows a standoff device 201, also flat-pattern formed and made from a single piece of material. This device includes a an L-shaped portion 202 configured to hook over a lower rail, an arm 203 extending outward in the same plane as the bottom part of portion 202 and a terminal frame portion 204, sized to be slid up or down on the leg and connected to the outer end of the arm at an angle of 10 to 15 degrees in order to project the leg outward at the bottom thereof. This structure avoids any need to bolt or clamp the standoff device to the leg.

Although the invention is described with reference to drywall panels, it is to be understood that the panels may be comprised of other materials such as plywood and other wood-based compositions as well as polymeric materials such as polycarbonates and glass.

The posts for panel-supporting legs preferably may be metal tubes having a rectangular or square cross-section, but the invention includes posts in the form of shapes such as angle iron, circular pipes, beams or the like.

It is also to be understood that although the invention is described above in terms of specific embodiments, it is not so limited, but is limited only as defined in the appended claims.

The invention claimed is:

1. Apparatus for supporting sheet material panels on a lift platform having a floor and a plurality of spaced-apart horizontal rails disposed around a periphery of said floor and above said floor, said apparatus comprising:

a pair of panel-supporting legs attachable to said rails, each said leg comprising a rigid post having a top end, a bottom end, a middle portion, a first side facing a said rail when installed and a second side facing away from said rail when installed;

each said leg at said top end having attached thereto an upper rail-engaging member located on said first side and adapted for being connected to an upper one of said rails;

each said leg also having attached thereto at a said middle portion thereof a lower rail-engaging member located on said first side and adapted for being connected to a lower one of said rails;

each said leg at a lower portion thereof having support members defining a panel-receiving channel on said second side facing away from said rails, said support members including a roller mounted on an axis perpendicular to said leg at said second side and providing a rotating base upon which a panel may be placed, said roller having a lip at each end thereof, defining therebetween a groove in which a said panel may be placed on edge and supported for movement in a direction parallel to said rails.

2. Apparatus as defined in claim 1 wherein said rail-engaging members comprises a plate having a proximate end joined to said top end of said leg and a distal end including a first bracket adapted to be hooked over a said rail and removably connected thereto.

3. Apparatus as defined in claim 2 including a second roller mounted on said plate on an axis parallel to said rails and having its circumference located outwardly past said second side of said leg whereby a panel in contact with said second roller will be kept spaced apart from said leg.

4. Apparatus as defined in claim 2 wherein said lower rail-engaging member comprises a second bracket connected to said middle portion and positioned in spaced apart relation to said leg.

5. Apparatus as defined in claim 4 including a standoff arm disposed between said leg and said second bracket whereby said leg may be placed in position so as to be tilted toward the rails at the upper end of the leg when installed.

6. Apparatus as defined in claim 5 including a sleeve slidably disposed over said leg and connected to a proximate end of said standoff arm whereby said second bracket may be moved to variable vertical positions.

7. Apparatus as defined in claim 6 including a first pair of rollers mounted on said leg at a middle location thereof, each roller of said pair placed across from one another and on an axis parallel to said leg and each said roller of said pair having a circumference extending outwardly past said second side of said leg, whereby contact of a supported panel with said second side will be prevented and movement of a panel in a longitudinal direction will be facilitated.

8. Apparatus as defined in claim 7 further comprising a second pair of rollers mounted on said leg adjacent said panel-receiving channel, each roller of said second pair placed across from one another on an axis parallel to said leg, and each roller of said second pair having a circumference extending outwardly past said second side of said leg whereby contact of a supported panel with said second side will be prevented.

9. Apparatus as defined in claim 5 wherein said standoff arm comprises a an L-shaped portion shaped to hook over a lower rail, an arm extending outward in the same plane as a bottom part of said L-shaped portion and a terminal frame extending upward at an angle of 10 to 15 degrees which causes a said leg to be projected outwardly at a base thereof.

10. Apparatus as defined in claim 1 including a bumper made of low friction plastic material disposed along a vertically extending portion of said second side of said legs.

11. Apparatus as defined in claim 1 wherein said support members defining a panel-receiving channel comprise an assembly removably attachable to said leg at a selected one of a plurality of vertically spaced apart locations on said leg.

12. Apparatus as defined in claim 1 wherein said each of said panel-receiving channels takes the form of a U-shaped channel assembly in which rollers at a base position of the channel are mounted on a pair of tabs integral with a sleeve slidably disposed over a said leg.

13. Apparatus as defined in claim 12 wherein said sleeve is held in position by means of a spring-driven pin.

14. Apparatus as defined in claim 12 including a bottom stop connected to each leg underneath a panel-receiving channel.

15. Apparatus as defined in claim 1 wherein said upper rail engaging member comprises a roller mount integral with a bracket.

* * * * *